US012383797B1

(12) United States Patent
Feldman et al.

(10) Patent No.: US 12,383,797 B1
(45) Date of Patent: Aug. 12, 2025

(54) SHOCK ABSORBING SWIM GOGGLES WITH INDEPENDENTLY MOVABLE LENSES AND METHOD OF USE

(71) Applicants: Eric Feldman, Dallas, TX (US); Everly Feldman, Dallas, TX (US)

(72) Inventors: Eric Feldman, Dallas, TX (US); Everly Feldman, Dallas, TX (US); Michael Levin, Bennington, NE (US)

( * ) Notice: Subject to any disclaimer, the term of this patent is extended or adjusted under 35 U.S.C. 154(b) by 0 days.

(21) Appl. No.: 18/790,703

(22) Filed: Jul. 31, 2024

(51) Int. Cl.
*A63B 33/00* (2006.01)

(52) U.S. Cl.
CPC ..... *A63B 33/004* (2020.08); *A63B 33/002* (2013.01)

(58) Field of Classification Search
CPC ... A63B 33/004; A63B 33/008; A63B 33/002; A63B 33/006; A61F 9/025; A61F 9/022; A61F 9/026; A61F 9/029; A61F 9/02; B63C 11/12
USPC .... 2/453, 440, 441, 443, 452, 434, 444, 445
See application file for complete search history.

(56) References Cited

U.S. PATENT DOCUMENTS 297,858 A * 4/1884 Smith ..... G02C 13/003 351/227
1,415,536 A * 5/1922 Ekwall ..... G02C 1/06 2/453
1,807,681 A * 6/1931 Baker ..... A61F 9/025 2/445
1,843,833 A 2/1932 Parsons
1,859,532 A * 5/1932 Rotolo ..... A61F 9/029 24/301
2,368,117 A 1/1945 Damian
2,655,657 A * 10/1953 Lueders ..... G02C 7/08 2/12
2,686,310 A * 8/1954 Schweikert ..... G02C 9/02 2/453
2,718,007 A 9/1955 Schauweker
2,998,610 A * 9/1961 Spero ..... G02C 9/02 2/13
3,379,487 A 4/1968 Amundsen
(Continued)

FOREIGN PATENT DOCUMENTS

CN 110997085 A * 4/2020 ..... A63B 33/002
GB 2347629 A 9/2000

OTHER PUBLICATIONS

Flip-up Safety Goggles. Accessed: May 21, 2024. https://sharkind.com/product/goggles-50mm-flip-up-acetylene-goggles/.
(Continued)

*Primary Examiner* — Amy Vanatta
(74) *Attorney, Agent, or Firm* — Schultz & Associates, P.C.

(57) ABSTRACT

This invention pertains to an improved design for goggles featuring a base frame with two generally cylindrical eye portions connected by a vertical support post. Each eye portion has an oval cross-section and includes a proximal opening fitted with a flexible oval eyepiece made from neoprene or similar material. The goggles incorporate hinge barrels and pins allowing for pivotable attachment of lens housings, which include distal windows and frustoconical seals to ensure a watertight fit. A magnetic support spacer mechanism provides stability and ease of use, enhancing the user experience in high-impact and aquatic environments by facilitating quick drainage of intruding water without removing the goggles.

20 Claims, 12 Drawing Sheets

(56) References Cited

U.S. PATENT DOCUMENTS

| | | | | |
|---|---|---|---|---|
| 3,383,155 | A * | 5/1968 | Bourke | A61F 9/061 351/59 |
| 3,555,563 | A * | 1/1971 | Grossman | G02C 7/16 351/85 |
| 3,990,788 | A | 11/1976 | Choy | |
| 4,353,134 | A | 10/1982 | Macnabb | |
| 4,989,274 | A | 2/1991 | Patelski, III | |
| 5,564,130 | A | 10/1996 | Feng | |
| D377,036 | S | 12/1996 | Leonardi | |
| 5,987,640 | A * | 11/1999 | Ryder | A42B 1/247 2/10 |
| 6,178,561 | B1 | 1/2001 | Cheng | |
| 6,349,420 | B1 * | 2/2002 | Chiang | A63B 33/004 2/441 |
| RE37,816 | E | 8/2002 | Kranhouse | |
| 6,848,785 | B1 | 2/2005 | Spillman | |
| 6,964,067 | B1 | 11/2005 | Hartman | |
| 7,058,991 | B2 * | 6/2006 | Hartman | A61F 9/025 2/437 |
| 7,866,812 | B1 | 1/2011 | Tullis | |
| 9,061,179 | B2 | 6/2015 | Stiff | |
| 9,352,191 | B2 | 5/2016 | Chiang | |
| 10,117,779 | B2 | 11/2018 | Waller et al. | |
| 10,173,103 | B1 | 1/2019 | Hahn | |
| 10,576,333 | B2 | 3/2020 | Chiang | |
| 2006/0072066 | A1 | 4/2006 | Mihelic | |
| 2016/0327810 | A1 | 11/2016 | Cross | |
| 2019/0146240 | A1 * | 5/2019 | Chen | G02C 5/02 351/43 |

OTHER PUBLICATIONS

The Magic 5 Swim Goggles. Accessed: May 21, 2024. https://themagic5.com/pages/how-it-works.

The HoloSwim. Accessed: May 21, 2024. https://www.g-mark.org/en/gallery/winners/14615?years=2023.

"Circuit 2 Goggles," finisswim.com. Accessed: May 23, 2024. https://www.finisswim.com/Circuit-2.

* cited by examiner

SHOCK ABSORBING SWIM GOGGLES WITH INDEPENDENTLY MOVABLE LENSES AND METHOD OF USE

FIELD OF THE INVENTION

The present invention pertains to swim masks and goggles, specifically addressing solutions for preventing and managing water intrusion during aquatic activities.

BACKGROUND OF THE INVENTION

Swim masks and goggles are essential for both recreational and competitive swimming, providing clear vision and protecting the eyes from chlorinated water and other irritants. However, a significant and common issue with these devices is the intrusion of water into the space between the user's eyes and the distal window of the mask. This intrusion often occurs due to improper fit, worn-out seals, or sudden impacts with water, causing discomfort and obstructing vision.

When water enters the mask, it compromises the user's ability to see clearly and requires immediate attention to drain the water. Typically, users must remove the mask or goggles entirely to empty the water, which is not only time-consuming but also distracting. This process can be particularly hazardous when performed underwater, as it increases the risk of disorientation and potential drowning.

Various attempts have been made to address this issue, including the development of better-fitting gaskets and the use of tighter straps to create a more secure seal against the face. Some modern goggles offer custom-fit solutions where the gaskets are designed according to the specific measurements of the user's face, thus providing a better seal.

Another example includes U.S. Reissued Patent No. RE37816, to Kranhouse. Kranhouse discloses a diving mask with hemispherically-shaped lenses mounted on a flexible gasket or portion and fitted to the contours of a user's face. The lenses' spherical centers coincide with the optical nodal point of the user's eyes, reducing underwater magnification-distortion. The invention includes laser scanning for custom fitting and may have purge valves for water expulsion. However, Kranhouse fails to disclose a base frame with cylindrical eye portions, oval receivers, and flexible eyepieces along with individually rotating elliptical lens housings providing watertight sealing with the base frame and drainage.

U.S. Pat. No. 10,576,333 to Chiang, discloses a set of swimming goggles comprising left and right frames, with protection pads designed to conform to the wearer's eye socket contours. The pads have a buffer device with compartments for impact absorption. Chiang fails to disclose a base frame with cylindrical eye portions and oval receivers, rotating lens housings with elliptical lenses, and a watertight sealing mechanism.

U.S. Pat. No. 2,718,007 to Schauweker, describes eye protective devices with a pair of goggle eyecups and hinged lens holding units that allow lenses to move into and out of the field of vision. It features hinged lens devices with a locking mechanism for adjusting lens positions. Schauweker's invention addresses the need for versatile eye protection that can adapt to different lighting conditions. But, Schauweker fails to disclose a base frame with cylindrical eye portions, oval receivers, flexible eyepieces, and rotating elliptical lens housings that pivot for watertight sealing and drainage.

U.S. Publication No. 2006/0072066 to Mihelic, discloses a pivot mechanism for a set of goggles with hinged lenses actuated by a linkage assembly connected to a chin strap. The chin strap mechanism allows hands-free operation, moving the lenses when the user opens their mouth. Mihelic's invention solves the problem of requiring hands to adjust protective lenses, improving efficiency and ease of use for wearers. But Mihelic fails to disclose pivoting elliptical lens housings connected to a base frame with oval receivers.

U.S. Pat. No. 10,117,779 to Waller, et al. discloses a set of goggles with an extra orbital design, having an outer surface defined by convex upper peripheral walls for a smooth curve. The goggles feature a structural configuration optimized for a secure fit and reduced drag. Waller's invention addresses the problem of high drag and poor fit in conventional goggle designs. However, Waller fails to disclose a base frame with cylindrical eye portions, flexible oval eyepieces, and hinged elliptical lens housings designed for watertight sealing and pivoting to allow drainage.

Despite these advancements, the problem of water intrusion persists in the field of swim goggles, particularly in high-impact or long-duration swimming activities. The present invention seeks to address this persistent problem by providing an innovative solution that allows for the removal of intruding water without the need to remove or refit the goggles during use. The invention comprises a base frame with cylindrical eye portions, oval receivers, flexible eyepieces, and pivoting elliptical lens housings, all designed to manage water intrusion effectively and quickly without the need to remove the goggles. This design not only enhances the user experience by maintaining a watertight seal but also offers a convenient way to drain water while still wearing the mask or goggles, thereby improving safety and comfort during swimming activities.

SUMMARY OF THE INVENTION

The invention comprises a base frame designed to ensure a secure and watertight fit while allowing easy drainage of any water that may intrude. The base frame includes two generally cylindrical eye portions joined by a vertical support post. Each eye portion incorporates an oval receiver that connects to a flexible oval eyepiece. These eyepieces are designed to rest comfortably on the user's face and are made of neoprene rubber or another flexible sealing material to provide a watertight fit and reduce the impact of the goggles against the face of the user.

A key structural component of the invention is the vertical support post, which includes two diametrically opposed hinge barrels. Each barrel supports a hinge pin, to which an elliptical lens housing is attached. Each elliptical lens housing includes a clear acrylic window sealed at its distal end, providing a clear viewing area for the user. Each lens housing may rotate about the hinge pin between an open configuration and a closed configuration. In the open configuration, the lens housings are positioned upward away from the oval receivers so that water to be drained out of the lens housings without the need to remove the goggles. In the closed configuration, each lens housing is fitted tightly against an oval receiver, forming a watertight seal.

To ensure that the lens housings remain securely in place when in the closed configuration, a mechanical interference catch is provided at the base of each lens housing. Further, each lens housing includes a support spacer. The support spacers are diametrically opposed and are in contact with each other when the lens housings are in the closed configuration. Each support spacer also includes a magnet encapsulated in plastic. The magnets have complimentary poles which provide a magnetic attraction to provide an additional closure force that secures the lens housings when the goggles are in the closed configuration.

The invention's structural components work together to solve the problem of water intrusion. The flexible oval eyepieces provide a comfortable, impact resistant, water-tight seal against the user's face, while the cylindrical eye portions and vertical support post offer stability and support. The pivoting elliptical lens housings allow for easy drainage of water, and the magnetic support spacers and mechanical interference catches ensure that the housings remain securely closed.

The innovative goggle design effectively addresses the longstanding issue of water intrusion by providing a mechanism for easy drainage without the need to remove the goggles. The invention's unique combination of a base frame with cylindrical eye portions, flexible oval eyepieces, pivoting elliptical lens housings, and combined mechanical and magnetic sealing mechanisms provides a practical and efficient solution for swimmers and divers. This design not only improves the user experience by reducing distractions and potential safety hazards associated with traditional swim masks and goggles but also enhances the overall functionality and reliability of the eyewear.

BRIEF DESCRIPTION OF THE DRAWINGS

In the detailed description of the preferred embodiments presented below, reference is made to the accompanying drawings.

DETAILED DESCRIPTION OF THE INVENTION

In the description that follows, like parts are marked throughout the specification and figures for the same numerals. The figures are not necessarily drawn to scale and may be shown in exaggerated or generalized form in the interest of clarity and conciseness. Unless otherwise noted, all tolerances and uses of the term "about" indicate plus or minus 20%.

Referring then to FIGS. 1-9, a preferred embodiment of goggles 100 will be described.

Goggles 100 include base frame 102. Base frame 102 comprises eye portion 104 and eye portion 106. Each eye portion is generally cylindrical about its central axis, having an oval cross-section. Eye portion 104 includes distal opening 104*a* and proximal opening 104*b*. Likewise, eye portion 106 includes distal opening 106*a* and proximal opening 106*b*. Base frame 102 is preferably a rigid plastic such as polypropylene or a suitable rigid acrylic resin.

Proximal opening 104*b* assumes an arcuate shape. Likewise, proximal opening 106*b* assumes an arcuate shape. The arcuate proximal openings are complimentary mirror images of each other, and are designed to generally conform to the eye sockets of the wearer.

Figure 1:
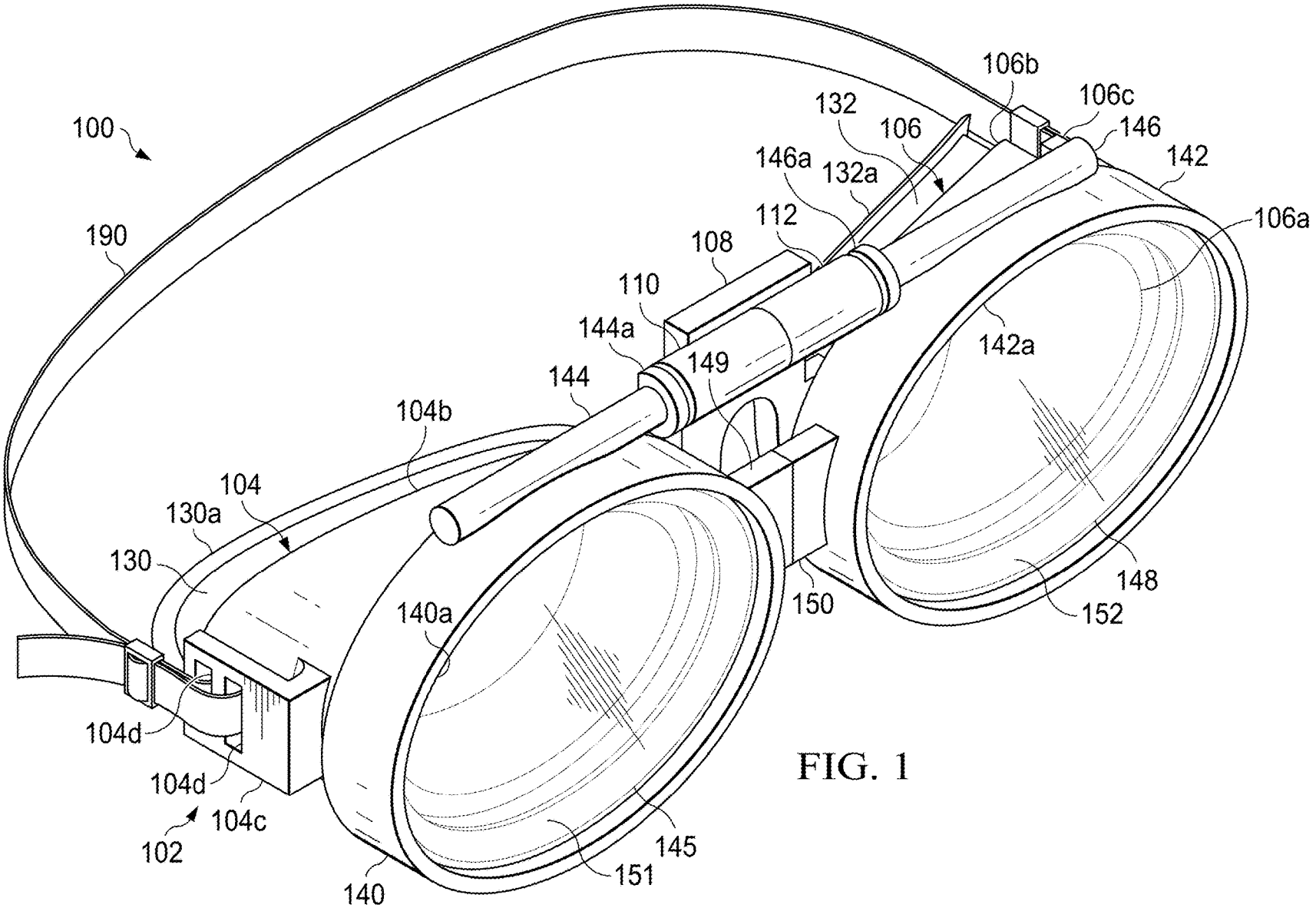
FIG. 1 is an isometric view of a preferred embodiment of the swim goggles.
Figure 2:
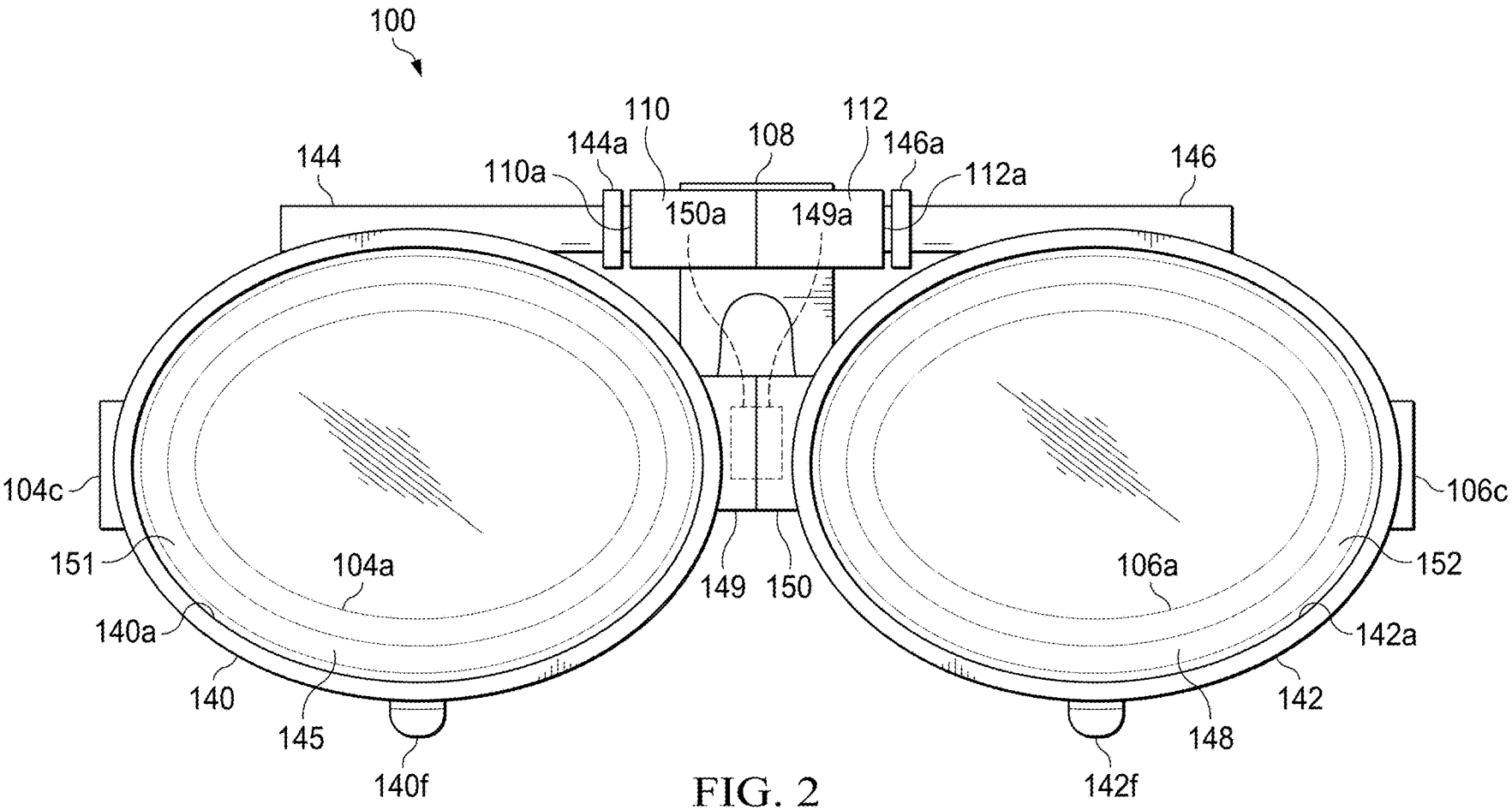
FIG. 2 is a front view of a preferred embodiment of the swim goggles.
Figure 3:
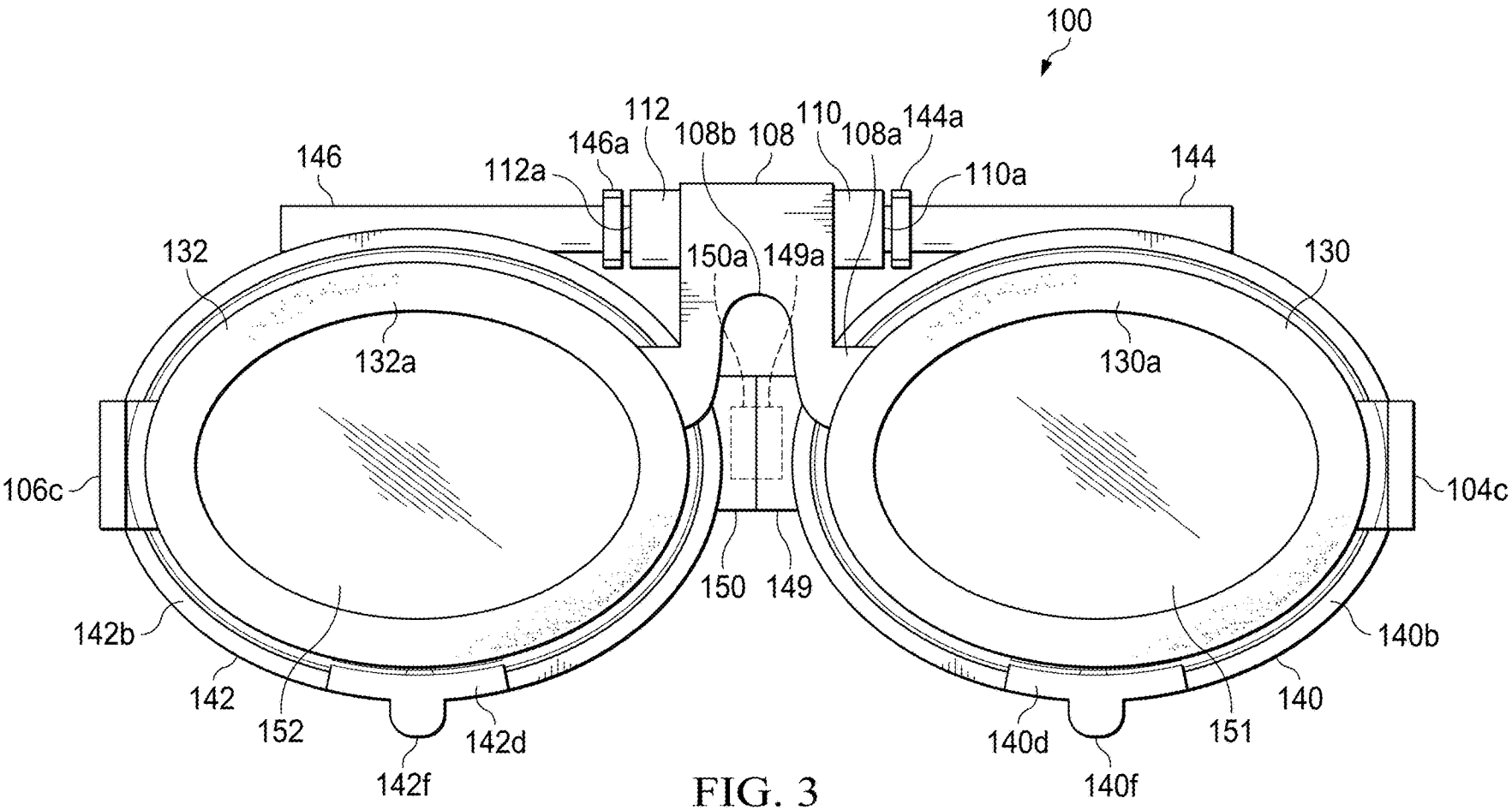
FIG. 3 is a rear view of a preferred embodiment of the swim goggles.
Figure 5:
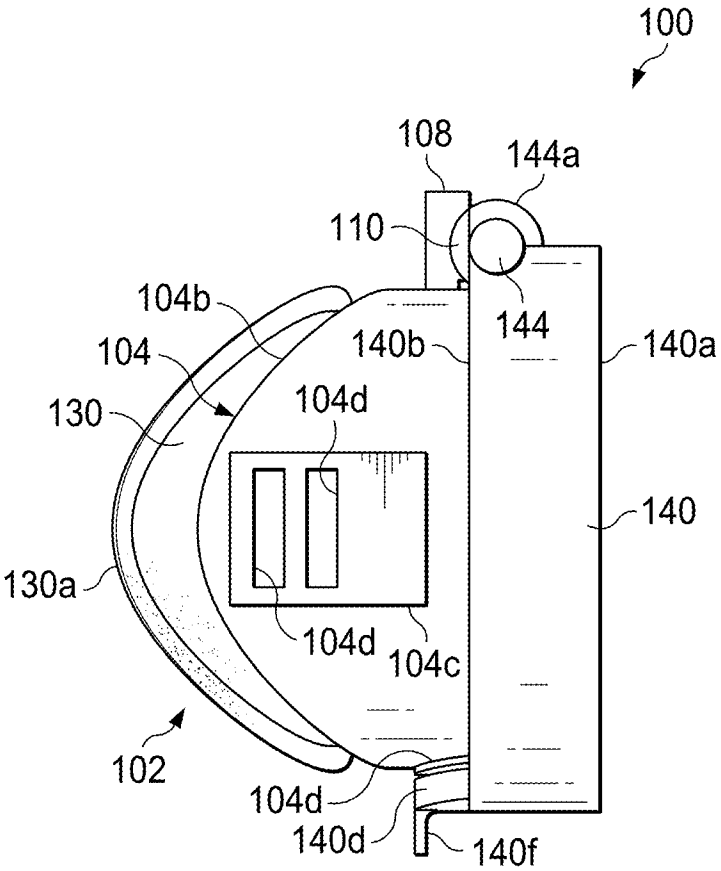
FIG. 5 is a right side view of a preferred embodiment of the swim goggles.
Figure 4:
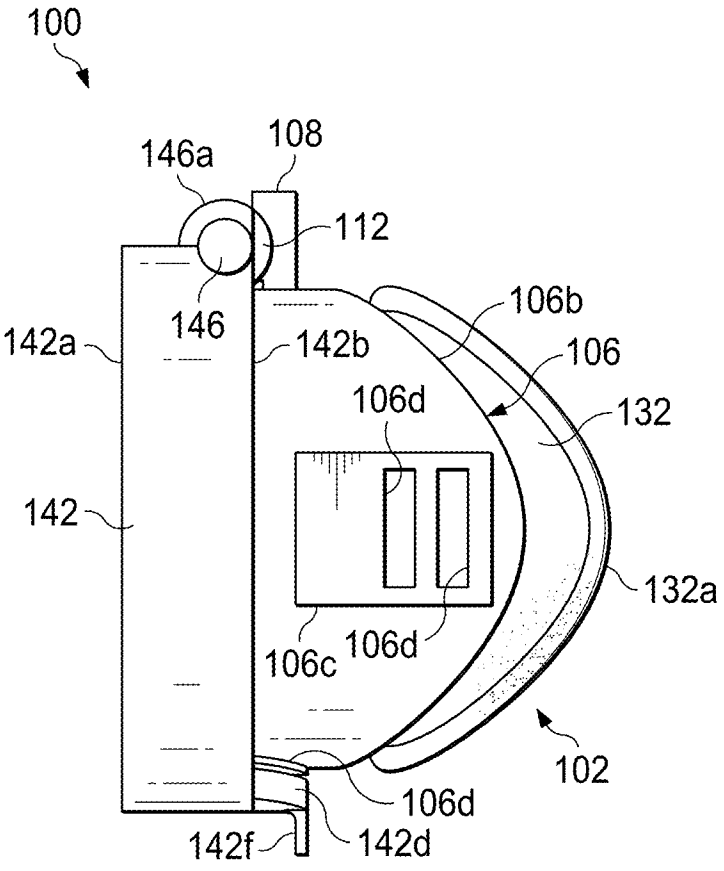
FIG. 4 is a left side view of a preferred embodiment of the swim goggles.

As can best be seen in FIGS. 1 and 3, eye portion 104 is rigidly connected to eye portion 106 through vertical support post 108. Vertical support post 108 includes connection bridge 108*a*. Connection bridge 108*a*, in use, is positioned above the nose bridge of the user and may include an arcuate indention 108*b* designed to conform to the nose bridge of the user.

Figure 9:
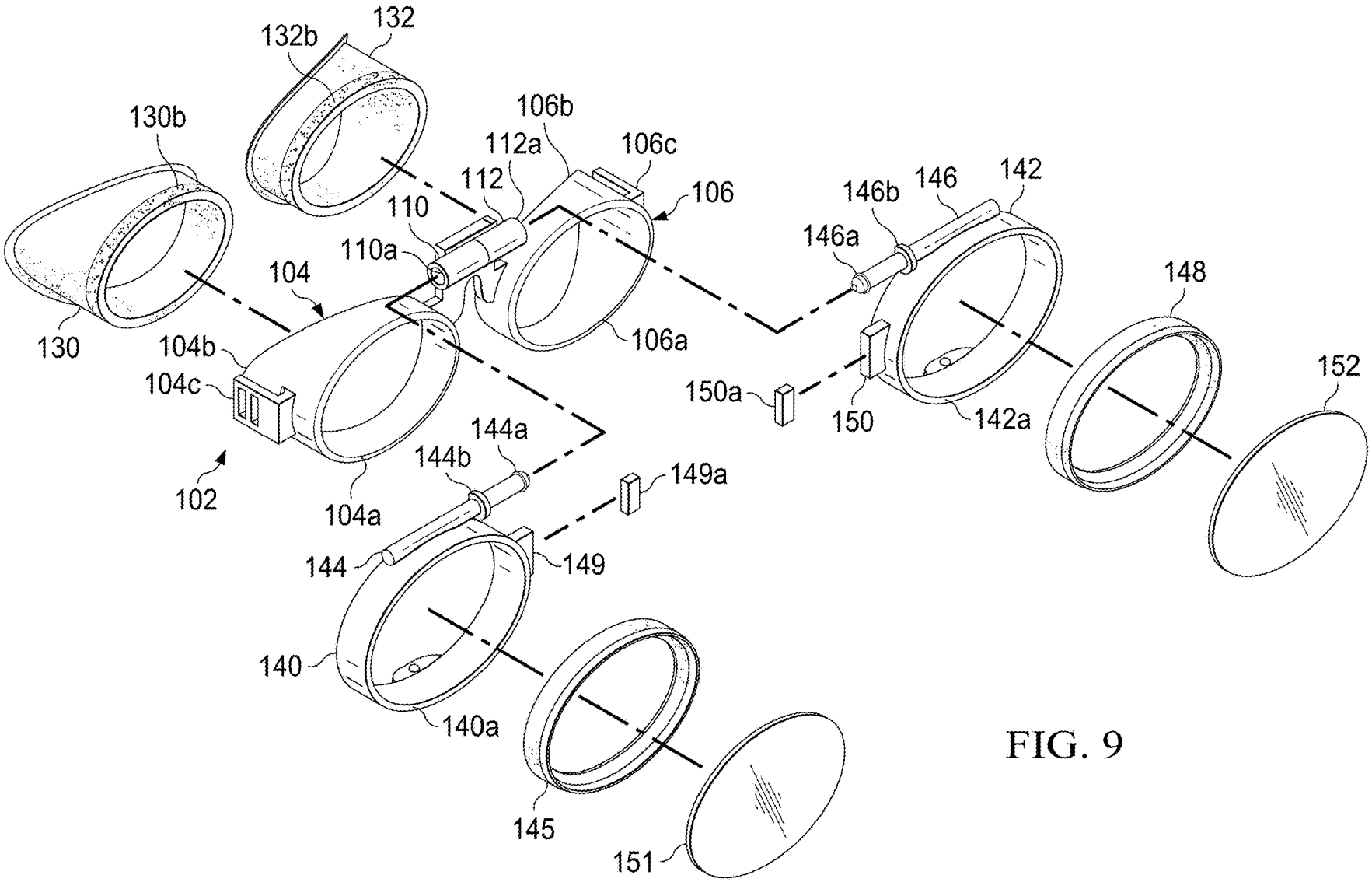
FIG. 9 is an exploded view of a preferred embodiment of the swim goggles.

As can best be seen in FIG. 9, oval eyepiece 130 is positioned within proximal opening 104*b*. Likewise, oval eyepiece 132 is positioned within proximal opening 106*b*. Oval eyepiece 130 and oval eyepiece 132 are formed of a flexible rubber material such as neoprene or latex, at a nominal thickness of between about 3 mm and about 5 mm.

Figure 8:
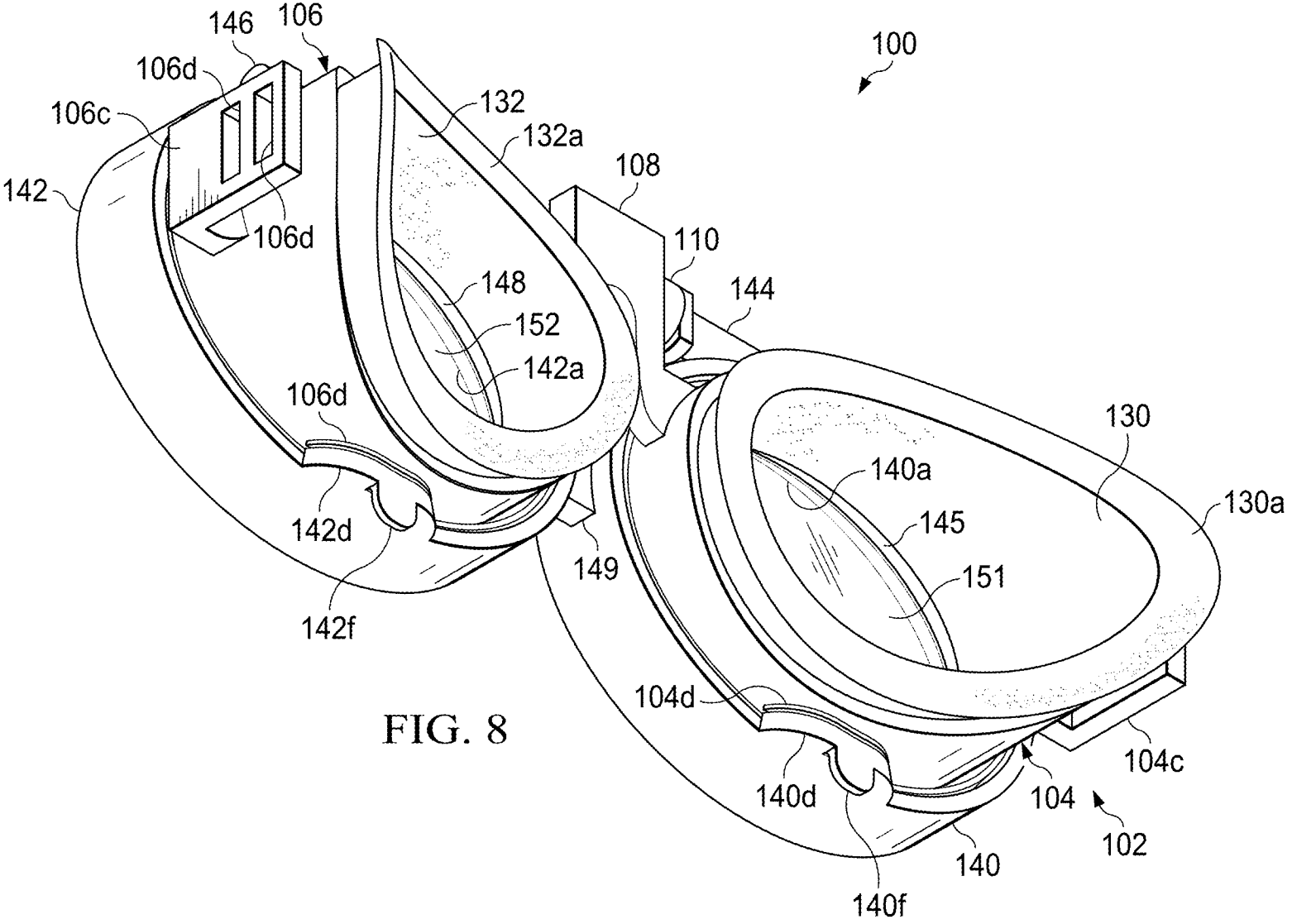
FIG. 8 is an isometric view of a preferred embodiment of the swim goggles.

As can be seen best from FIGS. 3, 8 and 9, oval eyepiece 130 further comprises a generally cylindrical structure having an oval cross section. Likewise oval eyepiece 132 is generally cylindrical having an oval cross section. The oval cross sections are sized to fit within the eye portions. Oval eyepiece 130 is fixed within eye portion 104 at its distal end by a suitable industrial waterproof adhesive ring 130*b*. Likewise, oval eyepiece 132 is fixed with the eye portion 106 at its distal end by a suitable industrial adhesive ring 132*b*. Oval eyepiece 130 further comprises seal flange 130*a*. Similarly, oval eyepiece 132 includes seal flange 132*a*. Each seal flange includes an arcuate rear surface which generally follows the arcuate proximal surfaces of the eye portions. The seal flanges are preferably integrally formed with the oval eyepieces and are designed to include a reduced cross-sectional width so as to be flexible to form fit to the face of the user.

Figure 6:
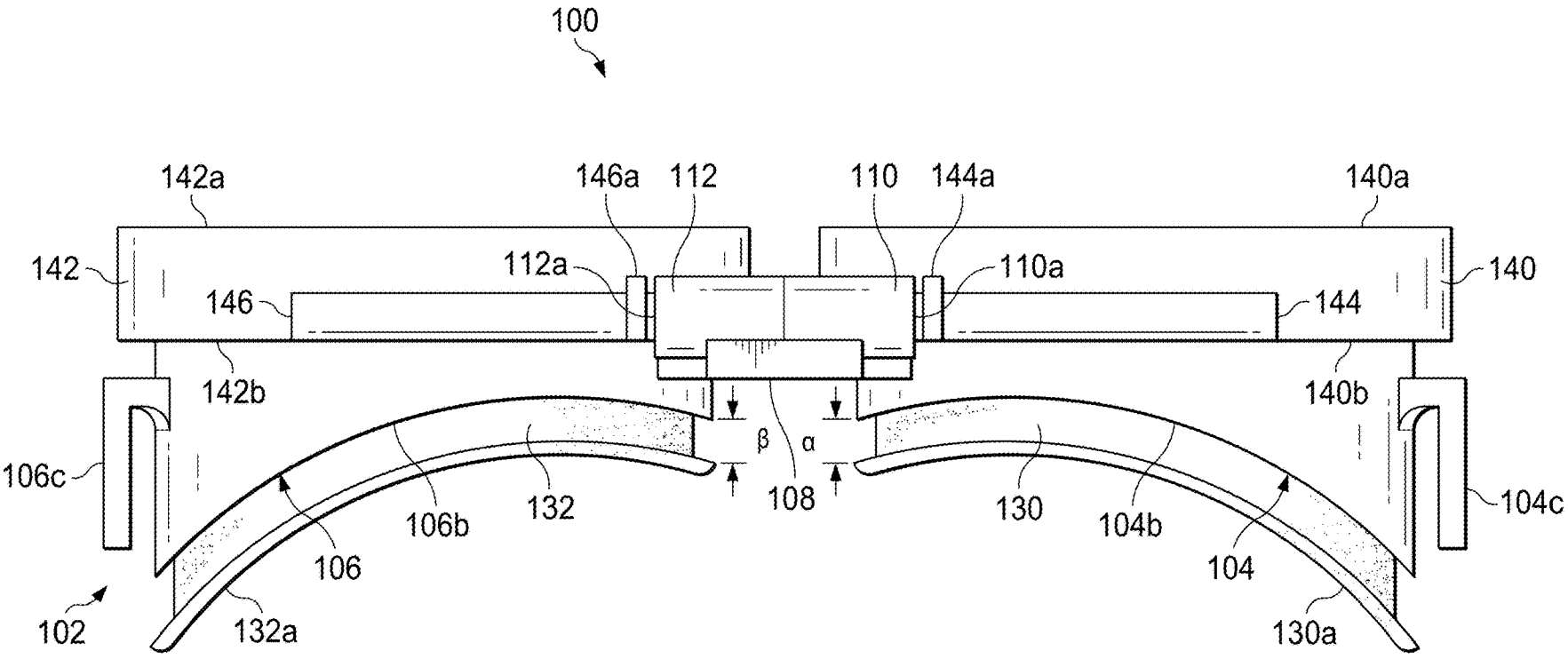
FIG. 6 is a top view of a preferred embodiment of the swim goggles.
Figure 7:
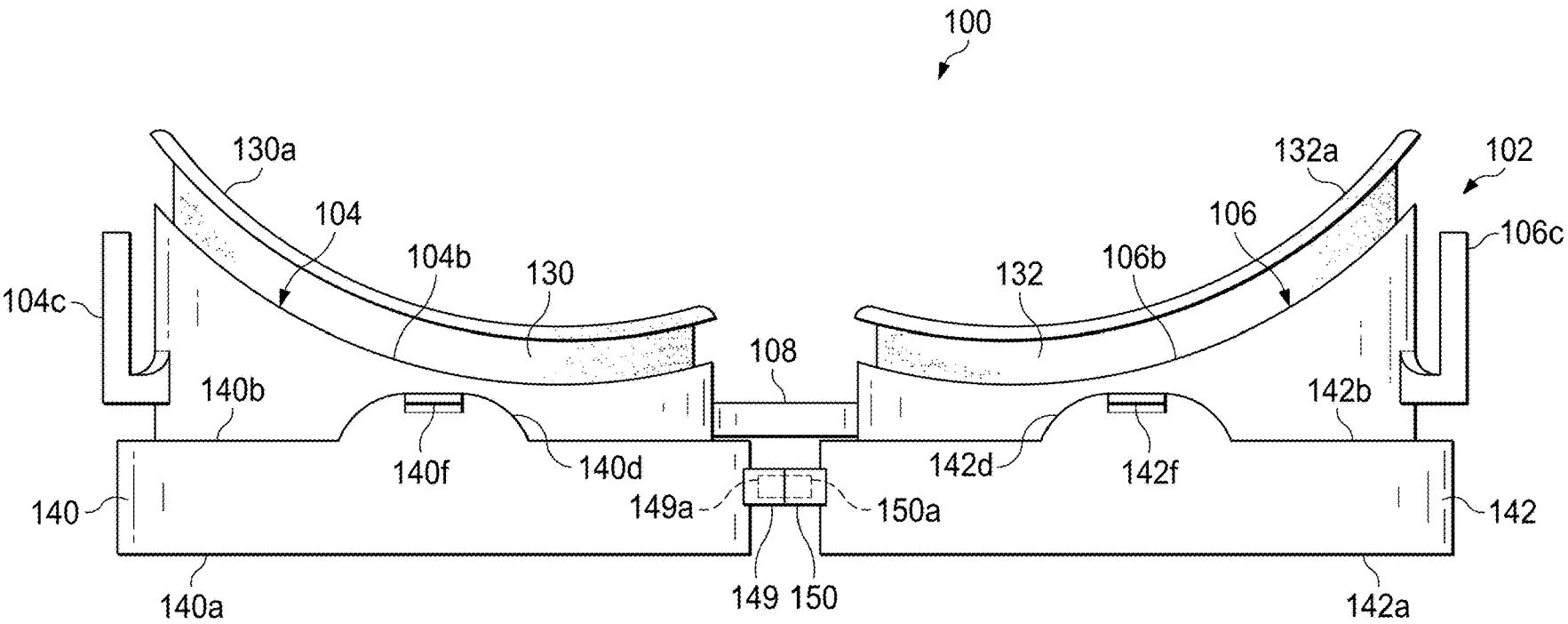
FIG. 7 is a bottom view of a preferred embodiment of the swim goggles.

As can best be seen in FIG. 6, oval eyepiece 130 extends out of and beyond proximal opening 104*b* by a distance a. Similarly oval eyepiece 132 extends outward from proximal opening 106*b* by a distance B. In a preferred embodiment, a and B are equal distances of between about 2 mm and about 10 mm. The flexible nature of the eyepieces allows them to be compressed easily when subjected to axial impact loading. Hence, the oval eyepieces act as "shock absorbers" to reduce the transmission of impact loading from the base frame to the face of the wearer. This is helpful in situations where the goggles are used in high-impact sports or long-distance swimming, where impact fatigue is a problem. The position of the adhesive rings is important because it allows each eyepiece to be compressed more than if the adhesive bonded a more significant amount of surface area to the eye portions, thereby permitting each eyepiece to dissipate significant impacts.

Eye portion 104 further includes strap flange 104*c*. Eye portion 106 further includes strap flange 106*c*. Strap flange

104*c* includes vertical slots 104*d*. Strap flange 106*c* includes vertical slots 106*d*. In use, strap 190 is threaded through the slots on the strap flanges and is used to adjustably hold the goggles against the face of the wearer.

Vertical support post 108 further comprises hinge barrel 110 and hinge barrel 112. The hinge barrels have colinear central axes. Each hinge barrel is preferably integrally formed with the vertical support post. However, in other embodiments the hinge barrels may be affixed to the vertical support post by a rigid adhesive or acrylic resin. In another embodiment, the hinge barrels may be formed as a single cylinder spanning the width of the support post.

As can best be seen from FIG. 9, goggles 100 further comprise lens housing 140 and lens housing 142. Lens housing 140 is generally cylindrical and has an oval cross section. Lens housing 142 is also generally cylindrical and has an oval cross section. The interior surfaces of the oval cross-sections are adapted to match the exterior of oval cross sections of the eye portions, but allow sufficient clearance for a sealing gasket, as will be further described. The central axis of lens housing 140 is collinear with the central axis of eye portion 104. Likewise, the central axis of lens housing 142 is collinear with the central axis of eye portion 106. Each lens housing is formed of a rigid plastic material such as polyvinyl chloride, polycarbonate, or poly(methyl methacrylate).

Hinge barrel 110 further includes receiver hole 110*a*. Likewise, hinge barrel 112 includes receiver hole 112*a*. Receiver hole 110*a* and receiver hole 112*a* have generally colinear central axes.

Hinge pin 144 is a rigid cylindrical rod which is fixed to lens housing 140 or, may be integrally formed with lens housing 140. Similarly, hinge pin 146 is a rigid cylindrical rod which is fixed to or integrally formed with lens housing 142. Hinge pin 146 fits within receiver hole 110*a*. Hinge pin 146 fits within receiver hole 112*a*. Hinge pin 144 is maintained in receiver hole 110*a* through a friction fit with friction ring 144*a*. Likewise, hinge pin 146 is maintained in receiver hole 112*a* via friction fit with friction ring 146*a*. Hinge pin 144 further comprises stop ring 144*b*. Hinge pin 146 further comprises stop ring 146*b*. The stop rings limit the travel of the hinge pins into the receiver holes. The friction fit of each hinge pin allows it to rotate within the hinge barrel, about its axis, in order to raise and lower each lens housing away from its adjacent eye portion, as will be further described. An appropriate silicon grease can be positioned between the hinge pin and the hinge cylinder to allow free rotation.

Lens housing 140 further comprises generally rectangular support spacer 149 fixed to its exterior surface and directed toward lens housing 142. Likewise, lens housing 142 includes a generally rectangular support spacer 150 rigidly fixed to its exterior surface and directed toward lens housing 140. In the closed configuration, the support spacers touch each other, so as to offer horizontal stability to the eyepieces, but may slide past each other so as not interfere with the individual rotation of the lens housings.

Support spacer 149 further includes embedded magnet 149*a*. Support spacer 150 further includes embedded magnet 150*a*. The magnets are preferably encapsulated in the support spacers. Preferably, each of the magnets is comprised of a neodymium material. Each of the magnets is positioned with opposite poles facing each other so that an attractive force between them is generated when the lens housings are in the closed position, as will be further described.

Frustoconical seal 145 is positioned within lens housing 140, adjacent distal opening 140*a*. Frustoconical seal 148 is positioned in eye portion 106, adjacent distal opening 142*a*. The frustoconical seals are preferably made from a pliable, waterproof, synthetic rubber or neoprene material. Each of the frustoconical seals is held in position its by a suitable watertight industrial adhesive. The frustoconical seals are sized to form an interference fit between each eye portion and its adjacent lens housing so as to prevent ingress of water into the goggles when the lens housings are in the closed position.

Figure 10A:
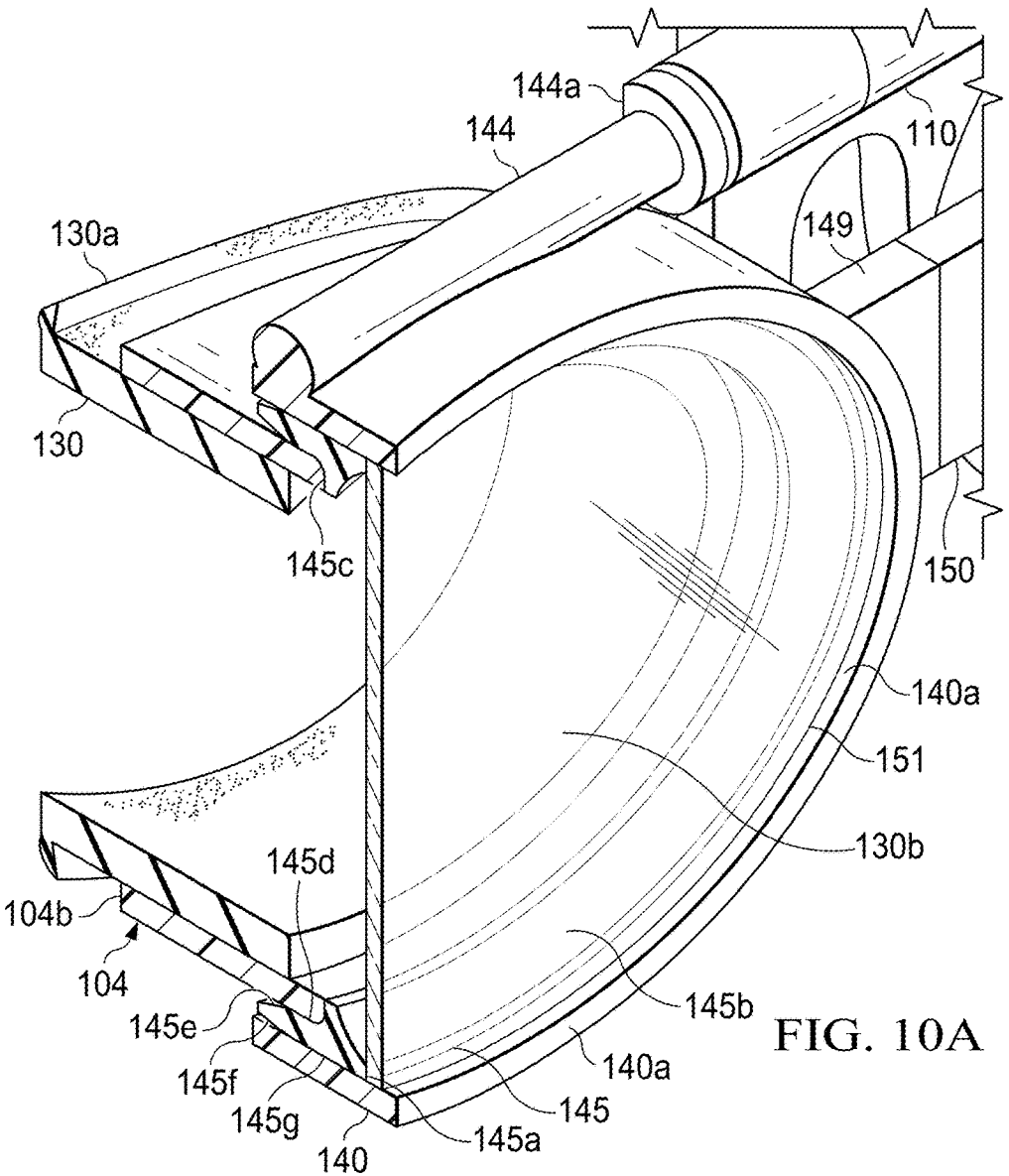
FIG. 10A is a partial section view of a preferred embodiment of the swim goggles.

As can also be seen in FIG. 10A, frustoconical seal 145 further comprises lens support surface 145*a*. Lens support surface 145*a* is generally planar and is bonded to distal window 151. In other preferred embodiments, distal window 151 may also be bonded to lens housing 140.

Lens support surface 145*a* is directly adjacent to taper surface 145*b*. In a preferred embodiment, taper surface 145*b* is generally arcuate. In other embodiments, taper surface 145*b* may be frustoconical.

Taper surface 145*b* terminates adjacent rear abutment surface 145*c*. Rear abutment surface 145*c* is generally parallel to lens support surface 145*a* and distal opening 104*a*. In the closed configuration, rear abutment surface 145*c* is pressed against distal opening 104*a* by the mechanical connection of protrusion 140*e* and indention 104*e* as well as the magnetic attraction between magnet 149*a* and magnet 150*a*.

Rear abutment surface 145*c* is adjacent releasable seal surface 145*d*. Releasable seal surface 145*d* impinges on the exterior of eye portion 104 adjacent distal opening 104*a* and forms an annular seal with eye portion 104 in a closed configuration.

Converging top surface 145*e* is adjacent releasable seal surface 145*d*. Likewise, converging bottom surface 145*f* is adjacent converging top surface 145*e*. In use, the converging top and converging bottom surface are sufficiently flexible to allow frustoconical seal 145 to give way as the lens housing is moved to and from the open and closed configurations, thereby facilitating a watertight seal between releasable seal surface 145*d* and eye portion 104.

Fixed seal surface 145*g* is adjacent converging bottom surface 145*f* and lens support surface 145*a*. In a preferred embodiment, fixed seal surface 145*g* is permanently adhered to lens housing 140 by a suitable waterproof industrial adhesive.

Figure 10B:
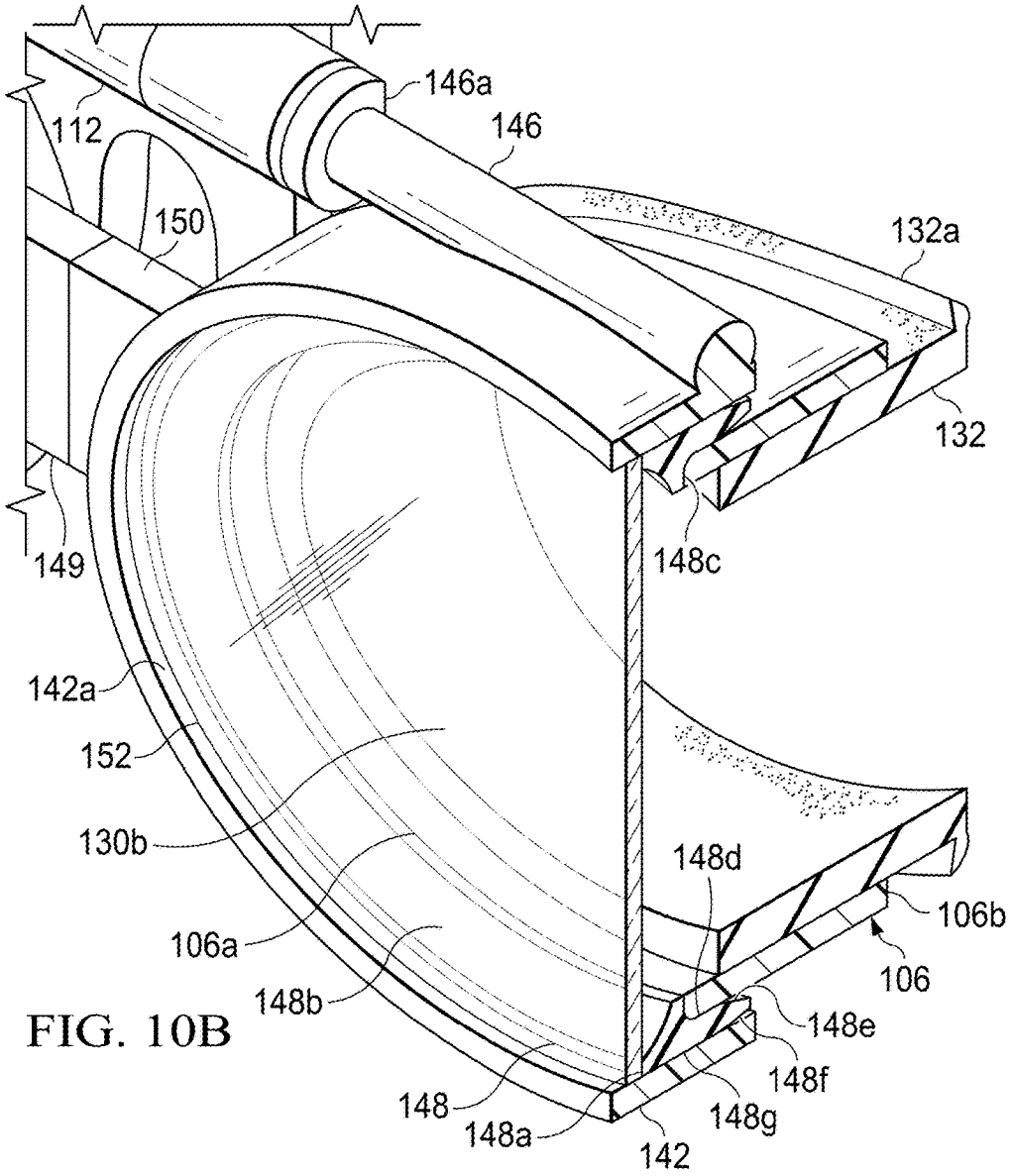
FIG. 10B is a partial section view of a preferred embodiment of the swim goggles.

As can also be seen in FIG. 10B, frustoconical seal 148 further comprises lens support surface 148*a*. Lens support surface 148*a* is generally planar and is bonded to distal window 152. In other preferred embodiments, distal window 152 may also be bonded to lens housing 142.

Lens support surface 148*a* is directly adjacent to taper surface 148*b*. In a preferred embodiment, taper surface 148*b* is generally arcuate. In other embodiments, taper surface 148*b* may be frustoconical.

Taper surface 148*b* terminates adjacent rear abutment surface 148*c*. Rear abutment surface 148*c* is generally parallel to lens support surface 148*a* and distal opening 106*a*. In the closed configuration, rear abutment surface 148*c* is pressed against distal opening 104*a* by the mechanical connection of protrusion 142*e* and indention 106*e* as well as the magnetic attraction between magnet 149*a* and magnet 150*a*.

Rear abutment surface 148*c* is adjacent releasable seal surface 148*d*. Releasable seal surface 148*d* impinges on the exterior of eye portion 106 adjacent distal opening 106*a* and forms an annular seal with eye portion 106 in a closed configuration.

Converging top surface 148*e* is adjacent releasable seal surface 148*d*. Likewise, converging bottom surface 148*f* is adjacent converging top surface 148*e*. In use, the converging top and converging bottom surfaces are sufficiently flexible to allow frustoconical seal 148 to give way as the lens housing is moved to and from the open and closed configurations, thereby facilitating a watertight seal between releasable seal surface 148*d* and eye portion 106.

Fixed seal surface 148*g* is adjacent converging bottom surface 148*f* and lens support surface 148*a*. In a preferred embodiment, fixed seal surface 148*g* is permanently adhered to lens housing 142 by a suitable waterproof industrial adhesive.

As can also be seen in FIG. 9, distal window 151 is positioned in distal opening 140*b* adjacent frustoconical seal 145. Distal window 152 is positioned in proximal opening 142*b* adjacent to and sealed against frustoconical seal 148. Distal window 151 and distal window 152 are both a transparent acrylic plastic which is shatter resistant such as Lucite, Plexiglas, Acrylate or a polycarbonate material. In a preferred embodiment, the distal windows are fixed to their adjacent frustoconical seals with a suitable adhesive. Importantly, fixing the windows to the seals, and not the lens housings, allows the windows to move with respect to the housings by compressing the seals, which allows the seals to absorb impact forces imposed on the windows from water or other causes, thereby reducing the impact transmitted to the face of the wearer.

Figure 11:
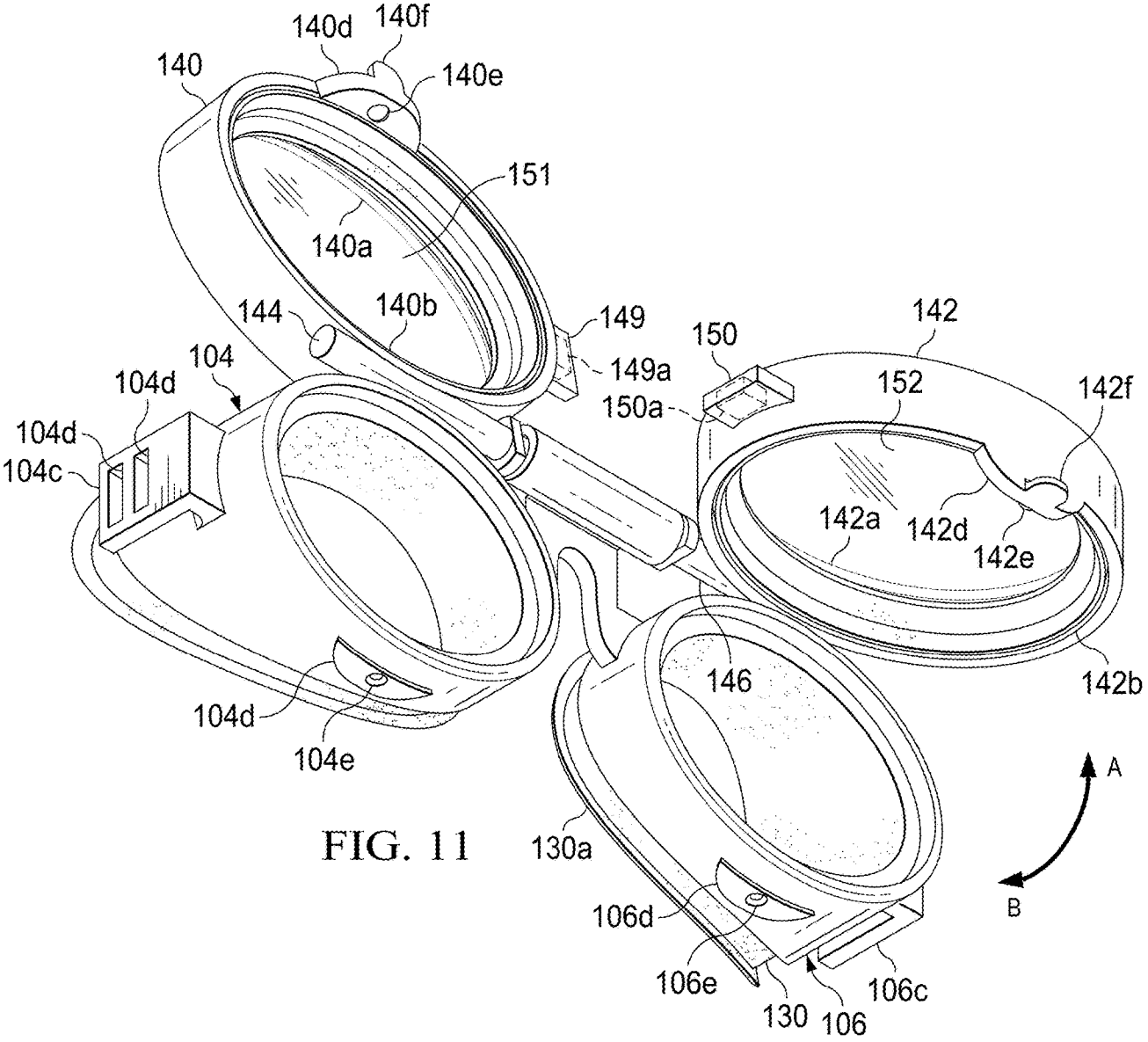
FIG. 11 shows a preferred embodiment of the swim goggles in use.

As can best be seen in FIG. 11, lens housing 140 further comprises clasp flange 140*d*. Clasp flange 140*d* is preferably integrally formed with lens housing 140. Clasp flange 140*d* includes protrusion 140*e* on its underside. Clasp flange 140*d* further comprises of outwardly facing tab 140*f*. Protrusion 140*e* is sized to fit within indention 104*e*. Lens housing 142 includes clasp flange 142*d*. Clasp flange 142*d* is preferably integrally formed with lens housing 142. Clasp flange 142*d* includes outwardly facing tab 142*f*. On its underside, clasp flange 142*d* includes protrusion 142*e*. Clasp flange 140*d* includes protrusion 140*e*. Protrusion 142*e* is sized to fit within indention 106*e*. In the closed configuration, each of the protrusions fits into a receiving indention in order to hold the lens housings in the closed position through an interference fit. In order to release each lens housing to move to the open position, each tab is rotated upward, which bends each clasp flange slightly, thereby removing its protrusion from the corresponding indention to releasing the lens housing.

Figure 12:
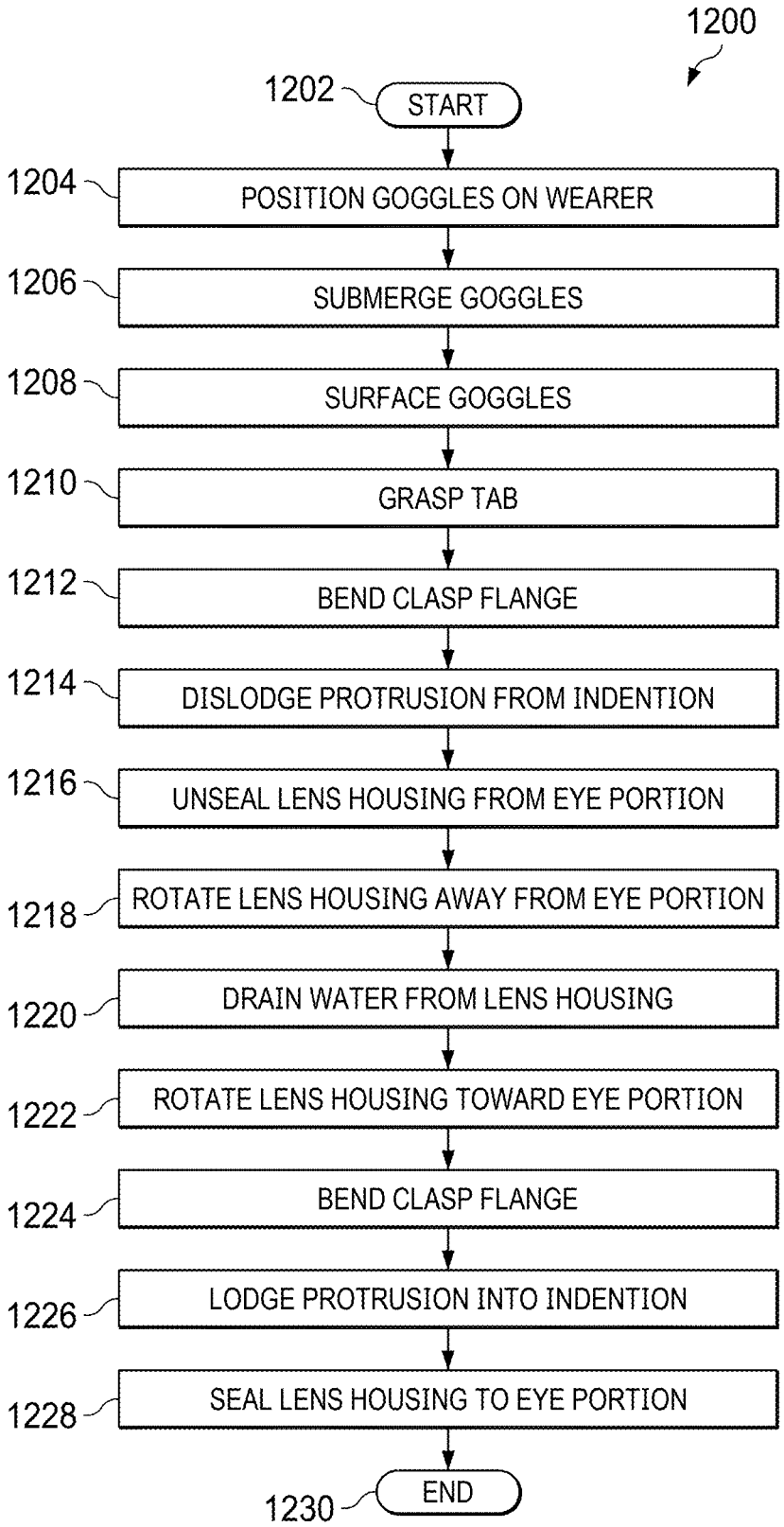
FIG. 12 is a flowchart of a preferred method of use of the swim goggles.

Referring then to FIG. 12, method of use 1200 of a preferred embodiment of the goggles will be further described.

At step 1202, the method begins with both lens housings in the closed configuration.

At step 1204, the goggles are positioned on the wearer by placing the eyepieces over the eyes and adjusting the head strap behind the head of the wearer.

At step 1206, the wearer and the goggles are submerged for a length of time sufficient to allow water to intrude into the goggles within one or another of the eyepieces and lens housings.

At step 1208, the wearer and the goggles surface above water.

At step 1210, one or both of the tabs on either lens housings is grasped. It should be understood that the method applies equally to either or both of the lens housings, which may be opened and closed independently with respect to the other lens housing.

At step 1212, the adjacent clasp flange is deformed downward.

At step 1214, the protrusion is released from the indention.

At step 1216, the lens housing is unsealed from the eye portion. This results in moving the frustoconical seal away from the eye portion.

Referring also to FIG. 11, at step 1218, the lens housing is rotated away from the eye portion by pivoting the hinge pin in the hinge barrel and disassociating the magnets in the support spacers, thereby allowing rotation of the lens housing upward, in direction "A", to the open configuration.

At step 1220, water is drained from the inside of the lens housing while the lens housing is in its open configuration.

At step 1222, to reposition the lens housing in the closed configuration, the lens housing is rotated downward toward the eye portion, in direction "B".

At step 1224, the clasp flange is bent to allow the lens housing to be positioned on the eyepiece.

At step 1226, the protrusion is lodged into the indention.

At step 1228, the frustoconical seal is sealed to the exterior of the eye portion, thereby placing the lens housing in the closed configuration.

At step 1230, the method concludes.

The invention claimed is:

1. A pair of swim goggles comprising:

a first rigid oval eye portion;

a second rigid oval eye portion, connected to the first rigid oval eye portion by a support post;

a hinge barrel positioned on the support post;

a first hinge pin, pivotally positioned in the hinge barrel;

a second hinge pin, pivotally positioned in the hinge barrel;

a first lens housing, rigidly fixed to the first hinge pin;

a second lens housing, rigidly fixed to the second hinge pin;

a first multi-surface annular seal releasably sealed to a first exterior of the first rigid oval eye portion and permanently sealed to a first interior of the first lens housing;

a second multi-surface annular seal releasably sealed to a second exterior of the second rigid oval eye portion and permanently sealed to a second interior of the second lens housing;

a first transparent lens fixed in the first lens housing;

a second transparent lens fixed in the second lens housing;

a first resilient oval eye piece fixed to a second interior of the first rigid oval eye portion;

a second resilient oval eye piece fixed to a third interior of the second rigid oval eye portion; and wherein the first lens housing, independently from the second lens housing, may be rotated from a closed configuration, adjacent the first rigid oval eye portion, to an open configuration, away from the first rigid oval eye portion;

wherein the second lens housing, independently from the first lens housing, may be rotated from the closed configuration, adjacent the second rigid oval eye portion, to the open configuration, away from the second rigid oval eye portion.

2. The pair of swim goggles of claim 1, further comprising:

a strap adjustably attached to the first rigid oval eye portion and the second rigid oval eye portion.

3. The pair of swim goggles of claim 1, wherein:

the first lens housing further comprises a first support spacer, extending horizontally toward the second lens housing, generally parallel to the hinge barrel;

the second lens housing further comprises a second support spacer, extending horizontally toward the first lens housing, generally parallel to the hinge barrel; and the first support spacer slidingly engaged with the second support spacer.

4. The pair of swim goggles of claim 3, wherein:

the first support spacer further comprises a first magnet;

the second support spacer further comprises second magnet; and the first magnet is adjacent to and magnetically attracted to the second magnet, in the closed configuration.

5. The pair of swim goggles of claim 1, wherein:

the first rigid oval eye portion further comprises a first clasp member and the first lens housing further comprises a second clasp member;

the first clasp member mechanically engages the second clasp member in the closed configuration;

the second rigid oval eye portion further comprises a third clasp member and the second lens housing further comprises a fourth clasp member; and the third clasp member mechanically engages the fourth clasp member in the closed configuration.

6. The pair of swim goggles of claim 1, wherein:

the first multi-surface annular seal and the second multi-surface annular seal are made of a resilient rubber material;

the first transparent lens is sealed to the first multi-surface annular seal and may move with respect to the first lens housing; and the second transparent lens is sealed to the second multi-surface annular seal and may move with respect to the second lens housing.

7. The pair of swim goggles of claim 1, wherein:

the first rigid oval eye portion further comprises a first proximal end and a first distal end;

the first resilient oval eye piece extends through the first proximal end and is bonded to the first rigid oval eye portion adjacent the first distal end;

the second rigid oval eye portion further comprises a second proximal end and a second distal end; and the second resilient oval eye piece extends through the second proximal end and is bonded to the second rigid oval eye portion adjacent the second distal end.

8. The pair of swim goggles of claim 7, wherein:

the first distal end further comprises a first arcuate rear surface;

the second distal end further comprises a second arcuate rear surface;

the first resilient oval eye piece further comprises a first frustoconical seal flange;

the second resilient oval eye piece further comprises a second frustoconical seal flange;

the first frustoconical seal flange is adjacent to an entirety of the first arcuate rear surface; and the second frustoconical seal flange is adjacent to an entirety of the second arcuate rear surface.

9. The pair of swim goggles of claim 8, wherein:

the first frustoconical seal flange extends past the first arcuate rear surface by between about 2 mm and about 10 mm; and the second frustoconical seal flange extends past the second arcuate rear surface by between about 2 mm and about 10 mm.

10. The pair of swim goggles of claim 1, wherein:

the first multi-surface annular seal further comprises a first lens support surface adjacent the first transparent lens;

a first taper surface adjacent the first lens support surface;

a first rear abutment surface, adjacent to the first taper surface, and removably sealed against the first rigid oval eye portion in the closed configuration;

a first releasable seal surface, adjacent to the first rear abutment surface, and removably sealed against the first rigid oval eye portion in the closed configuration;

a first converging top surface adjacent the first releasable seal surface;

a first converging bottom surface adjacent the first converging top surface;

a second fixed seal surface, adjacent a second converging bottom surface, and permanently bonded to the first lens housing;

the second multi-surface annular seal further comprises a second lens support surface adjacent the second transparent lens;

a second taper surface adjacent the second lens support surface;

a second rear abutment surface, adjacent to the second taper surface, and removably sealed against the second rigid oval eye portion in the closed configuration;

a second releasable seal surface, adjacent to the second rear abutment surface, and removably sealed against the second rigid oval eye portion in the closed configuration;

a second converging top surface adjacent the second releasable seal surface;

the second converging bottom surface adjacent the second converging top surface; and the second fixed seal surface, adjacent the second converging bottom surface, and permanently bonded to the second lens housing.

11. A method of use of a pair of swim goggles comprising:

providing a first rigid oval eye portion;

providing a second rigid oval eye portion, connected to the first rigid oval eye portion by a support post;

providing a hinge barrel positioned on the support post;

providing a first hinge pin, pivotally positioned in the hinge barrel;

providing a second hinge pin, pivotally positioned in the hinge barrel;

providing a first lens housing, rigidly fixed to the first hinge pin;

providing a second lens housing, rigidly fixed to the second hinge pin;

providing a first multi-surface annular seal releasably sealed to a first exterior of the first rigid oval eye portion and permanently sealed to a first interior of the first lens housing;

providing a second multi-surface annular seal releasably sealed to a second exterior of the second rigid oval eye portion and permanently sealed to a second interior of the second lens housing;

providing a first transparent lens fixed in the first lens housing;

providing a second transparent lens fixed in the second lens housing;

providing a first resilient oval eye piece fixed to a second interior of the first rigid oval eye portion;

providing a second resilient oval eye piece fixed to a third interior of the second rigid oval eye portion;

rotating the first lens housing from a closed configuration, adjacent the first rigid oval eye portion, to an open configuration, away from the first rigid oval eye portion; and rotating the second lens housing from the closed configuration, adjacent the second rigid oval eye portion, to the open configuration, away from the second rigid oval eye portion.

12. The method of claim 11, further comprising:

providing a strap adjustably attached to the first rigid oval eye portion and the second rigid oval eye portion.

13. The method of claim 11, further comprising:

providing the first lens housing with a first support spacer, extending horizontally toward the second lens housing, generally parallel to the hinge barrel;

providing the second lens housing with a second support spacer, extending horizontally toward the first lens housing, generally parallel to the hinge barrel; and slidingly engaging the first support spacer with the second support spacer.

14. The method of claim 13, further comprising:

providing the first support spacer with a first magnet;

providing the second support spacer with second magnet; and whereby the first magnet is adjacent to and magnetically attracted to the second magnet, in the closed configuration.

15. The method of claim 11, further comprising:

providing the first rigid oval eye portion with a first clasp member;

providing the first lens housing with a second clasp member;

mechanically engaging the first clasp member with the second clasp member in the closed configuration;

providing the second rigid oval eye portion with a third clasp member;

providing the second lens housing with a fourth clasp member; and mechanically engaging the third clasp member with the fourth clasp member in the closed configuration.

16. The method of claim 11, further comprising:

providing the first multi-surface annular seal and the second multi-surface annular seal made of a resilient rubber material;

sealing the first transparent lens with the first multi-surface annular seal;

moving the first transparent lens with respect to the first lens housing;

sealing the second transparent lens to the second multi-surface annular seal; and moving the second transparent lens with respect to the second lens housing.

17. The method of claim 11, further comprising:

providing the first rigid oval eye portion with a first proximal end and a first distal end;

wherein the first resilient oval eye piece extends through the first proximal end and is bonded to the first rigid oval eye portion adjacent the first distal end; and providing the second rigid oval eye portion further comprises a second proximal end and a second distal end;

wherein the second resilient oval eye piece extends through the second proximal end and is bonded to the second rigid oval eye portion adjacent the second distal end.

18. The method of claim 17, further comprising:

providing the first distal end with a first arcuate rear surface;

providing the second distal end with a second arcuate rear surface;

providing the first resilient oval eye piece with a first frustoconical seal flange;

providing the second resilient oval eye piece with a second frustoconical seal flange; and wherein the first frustoconical seal flange is adjacent to an entirety of the first arcuate rear surface;

wherein the second frustoconical seal flange is adjacent to an entirety of the second arcuate rear surface.

19. The method of claim 18, wherein:

the step of providing the first frustoconical seal flange further comprises extending the first frustoconical seal flange past the first arcuate rear surface by between about 2 mm and about 10 mm; and the step of providing the second frustoconical seal flange further comprises extending the second frustoconical seal flange past the second arcuate rear surface by between about 2 mm and about 10 mm.

20. The method of claim 11, further comprising:

providing the first multi-surface annular seal with a first lens support surface adjacent the first transparent lens;

providing a first taper surface adjacent the first lens support surface;

providing a first rear abutment surface, adjacent to the first taper surface, and removably sealed against the first rigid oval eye portion in the closed configuration;

providing a first releasable seal surface, adjacent to the first rear abutment surface, and removably sealed against the first rigid oval eye portion in the closed configuration;

providing a first converging top surface adjacent the first releasable seal surface;

providing a first converging bottom surface adjacent the first converging top surface;

providing a second fixed seal surface, adjacent a second converging bottom surface, and permanently bonded to the first lens housing;

providing the second multi-surface annular seal with a second lens support surface adjacent the second transparent lens;

providing a second taper surface adjacent the second lens support surface;

providing a second rear abutment surface, adjacent to the second taper surface, and removably sealed against the second rigid oval eye portion in the closed configuration;

providing a second releasable seal surface, adjacent to the second rear abutment surface, and removably sealed against the second rigid oval eye portion in the closed configuration;

providing a second converging top surface adjacent the second releasable seal surface;

providing the second converging bottom surface adjacent the second converging top surface; and providing the second fixed seal surface, adjacent the second converging bottom surface, and permanently bonded to the second lens housing.

* * * * *